US009343796B2

(12) United States Patent
Yang et al.

(10) Patent No.: US 9,343,796 B2
(45) Date of Patent: May 17, 2016

(54) WIDEBAND AND LOW-LOSS QUADRATURE PHASE QUAD-FEEDING NETWORK FOR HIGH-PERFORMANCE GNSS ANTENNA

(71) Applicant: NovAtel Inc., Calgary (CA)

(72) Inventors: Ning Yang, Calgary (CA); Chad Gilbertson, Calgary (CA)

(73) Assignee: NovAtel Inc., Calgary (CA)

( * ) Notice: Subject to any disclaimer, the term of this patent is extended or adjusted under 35 U.S.C. 154(b) by 34 days.

(21) Appl. No.: 14/331,948

(22) Filed: Jul. 15, 2014

(65) Prior Publication Data

US 2016/0020502 A1 Jan. 21, 2016

(51) Int. Cl.

| | |
|---|---|
| ***H01P 5/12*** | (2006.01) |
| ***H01P 5/19*** | (2006.01) |
| ***H01P 1/18*** | (2006.01) |
| ***H01P 1/203*** | (2006.01) |
| *H01P 3/08* | (2006.01) |

(52) U.S. Cl.
CPC *H01P 5/19* (2013.01); *H01P 1/184* (2013.01); *H01P 1/203* (2013.01)

(58) Field of Classification Search
CPC ..... H01P 5/19; H01P 1/184; H01Q 21/0075
USPC ..... 333/117, 161, 238; 343/895, 905
See application file for complete search history.

(56) References Cited

U.S. PATENT DOCUMENTS

| | | | | |
|---|---|---|---|---|
| 5,138,331 | A | 8/1992 | Josypenko | |
| 5,828,348 | A * | 10/1998 | Tassoudji | H01Q 11/08 343/853 |
| 5,920,292 | A * | 7/1999 | O'Neill, Jr. | H01Q 11/08 343/702 |
| 6,608,604 | B1 * | 8/2003 | Sharaiha | H01P 5/222 343/702 |
| 6,803,838 | B2 * | 10/2004 | Hoyland | H01P 5/222 333/115 |
| 6,940,470 | B2 * | 9/2005 | Nesic | H01Q 1/38 343/895 |
| 7,999,755 | B2 | 8/2011 | Licul et al. | |
| 8,009,104 | B2 * | 8/2011 | Hossain | H01Q 3/44 343/700 MS |
| 2013/0265120 | A1 | 10/2013 | Park et al. | |
| 2014/0292604 | A1 * | 10/2014 | Kaneda | H01Q 19/30 343/772 |

OTHER PUBLICATIONS

Yang et al., Fixed-Beam Frequency-Tunable Phase-Reversal Coplanar Stripline Antenna Array, IEEE Transactions on Antennas and Propagation, Mar. 2009, pp. 671-681, vol. 57, No. 3.
Kim et al., Microstrip Phase Inverter using Slotted Ground, IEEE, 4 pages, 2010.
Chiu, et al., Performance enhancement of microwave circuits using parallel-strip line, IEEE Potentials, Sep./Oct. 2010, pp. 16-21.

* cited by examiner

*Primary Examiner* — Dean Takaoka
(74) *Attorney, Agent, or Firm* — Cesari and McKenna, LLP

(57) ABSTRACT

A system and method for a wide-band low loss quadrature phase antenna feed system is provided. A 180° phase shifter is configured to generate a 0° and 180° phase output. The phase shifter's outputs are fed into a 90° hybrid coupler to generate 0°, 90°, 180° and 270° outputs for used to feed a quadrature phase antenna.

10 Claims, 11 Drawing Sheets

WIDEBAND AND LOW-LOSS QUADRATURE PHASE QUAD-FEEDING NETWORK FOR HIGH-PERFORMANCE GNSS ANTENNA

FIELD OF THE INVENTION

The present invention relates to antenna feed systems and, more particularly, to quadrature phase antenna feed systems.

BACKGROUND INFORMATION

Global navigation satellite system (GNSS) multi-band antennas are typically utilized in GNSS systems for improved performance. For GNSS multi-band antennas, multiple feed points may be utilized to increase the axial-ratio beamwidth and/or bandwidth as well as improve the phase center variation (PCV) and phase center offset (PCO) associated with the antenna. Quadrature feed (quad feed) antennas, in which four feed points are utilized are common with GNSS antenna systems. However, a noted disadvantage of currently available quadrature feed systems is that they are single band and/or have a high loss. Typically, currently available quad direct feed systems only cover the L1 band. This does not provide adequate multi-band coverage that may be necessary for certain GNSS operations.

SUMMARY OF THE INVENTION

The disadvantages of the prior art are overcome by providing a quadrature feed antenna system that has little loss and provides multi-band coverage. The quad feed antenna system comprises of a 180° phase shifter followed by a pair of conventional 90° hybrid couplers. The 180° phase shifter utilizes a microstrip line phase reversal structure to generate the 180° phase reversal. In an illustrative embodiment, the phase reversal structure comprises a transition from a microstrip to a parallel strip line before the phase reversal occurs. After the phase reversal occurs, the parallel strip line is then transitioned back to a microstrip line. The phase reversal structure provides a high bandwidth and low loss mechanism to enable the phase reversal to generate 0° and 180° outputs that may be utilized by the hybrid couplers to generate the quadrature phase outputs for a GNSS system.

BRIEF DESCRIPTION OF THE DRAWINGS

The embodiments herein may be better understood by referring to the following description in conjunction with the accompanying drawings in which like reference numerals indicate identically or functionally similar elements, of which.

DETAILED DESCRIPTION OF AN ILLUSTRATIVE EMBODIMENT

Figure 1:
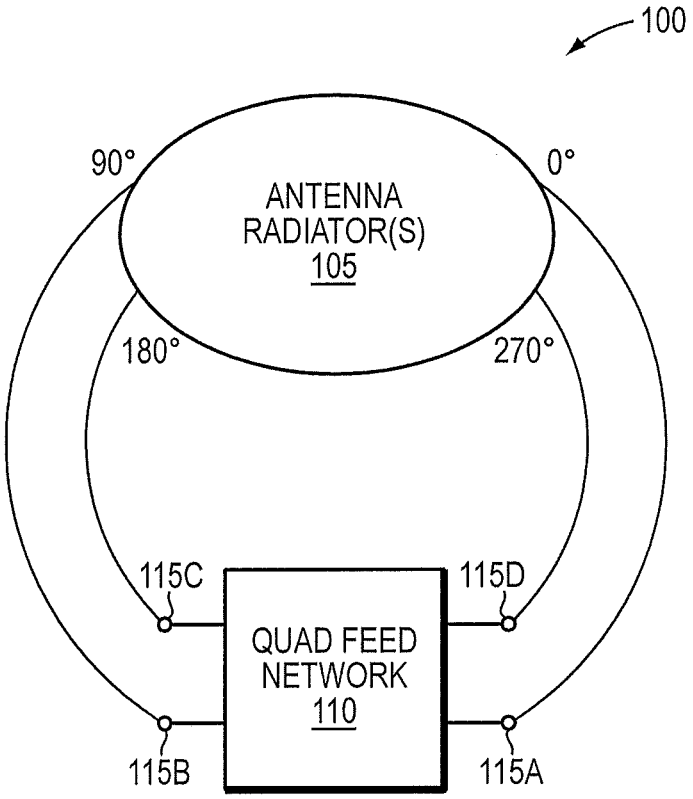
FIG. 1 is a schematic block diagram of an exemplary quadrature fed antenna in accordance with an illustrative embodiment of the present invention.

FIG. 1 is a schematic diagram of an exemplary quadrature fed antenna system 100 in accordance with an illustrative embodiment of the present invention. The antenna system 100 comprises of one or more antenna radiators 105 operatively interconnected with a quad feed network 110. The quadrature feed network 110 illustratively comprises of four feed points 115 A-D that provide signals at various phases, including, for example 0°, 90°, 180° and 270°. Exemplary feed point 115A provides a 0° phase, feed point 115B provides a 90° phase, feed point 115C provides a 180° phase and feed point 115D provides a 270° phase. It should be noted that the particular orientation of the feed points and the phases entering the antenna radiators are shown for illustrative purposes. As such the physical orientation of feed points in which phases are provided by particular feed points should be taken as exemplary only. Further, as will be appreciated by those skilled in the art, the actual values of the outputs of the quadrature feed system may differ in phase from that described were shown herein. For example, it is shown and described that the output has a 0, 90, 180 and 270° output; however, in alternative embodiments, the outputs may differ. As such, the description of specific output phases should be taken as exemplary only.

It should be noted that in accordance with an illustrative embodiment of the present invention, the antenna radiator 105 may comprise any form of quad feed antenna system. In one illustrative embodiment, the antenna radiators may comprise a GNSS antenna; however, it is expressly contemplated that in alternative embodiments of the present invention, differing in types of antennas may be utilized. As such, the description of a GNSS antenna being utilized should be taken as exemplary only. Similarly, the quad feed network 110 is shown for illustrative purposes of only. In a typical installation, a feed line (not shown) would provide for an input signal to the quad feed network 110.

Figure 2:
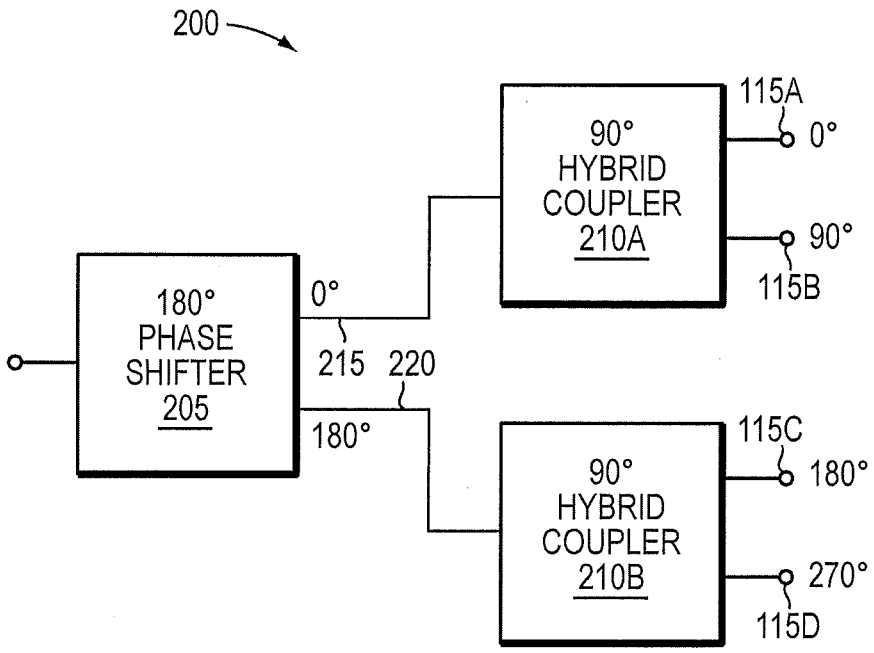
FIG. 2 is a schematic block diagram of an exemplary quadrature feeding network system in accordance with an illustrative embodiment of the present invention.

FIG. 2 is a schematic block diagram of an exemplary quadrature feed network 200 that may be utilized in accordance with an illustrative embodiment of the present invention. Illustratively, the quadrature feed network 200 comprises of a first and second stage. Illustratively, the first stage comprises of a 180° phase shifter 205 that illustratively generates two outputs 215, 220 that have a 180° phase difference, i.e., 0° and 180°. In accordance with an illustrative embodiment of the present invention, the 180° phase shifter 205 is implemented using the teachings of the present invention. The second stage of the feed network 200 illustratively comprises of a pair of 90° hybrid couplers 210A, B. Each of the hybrid couplers 210 accepts an input signal and generates two output signals having a 90° phase difference. Illustratively, the first hybrid coupler to 210A accepts an input phase of 0° and has output phases of 0° at points 115A and 90° at point 115B. Similarly, the second hybrid coupler 210B accepts as an input signal 220 having a 180° phase and outputs at point 115 C a 180° phase signal and at point 115D a 270° phase signal.

Conventional 90° quadrature hybrid couplers 210 are readily available. However, 180° phase shifters that have sufficiently wide bandwidth are difficult to find commercially. However, the present invention provides various embodiments of 180° phase shifters that may be utilized for an antenna feed network, such as a quad fed network.

Figure 3:
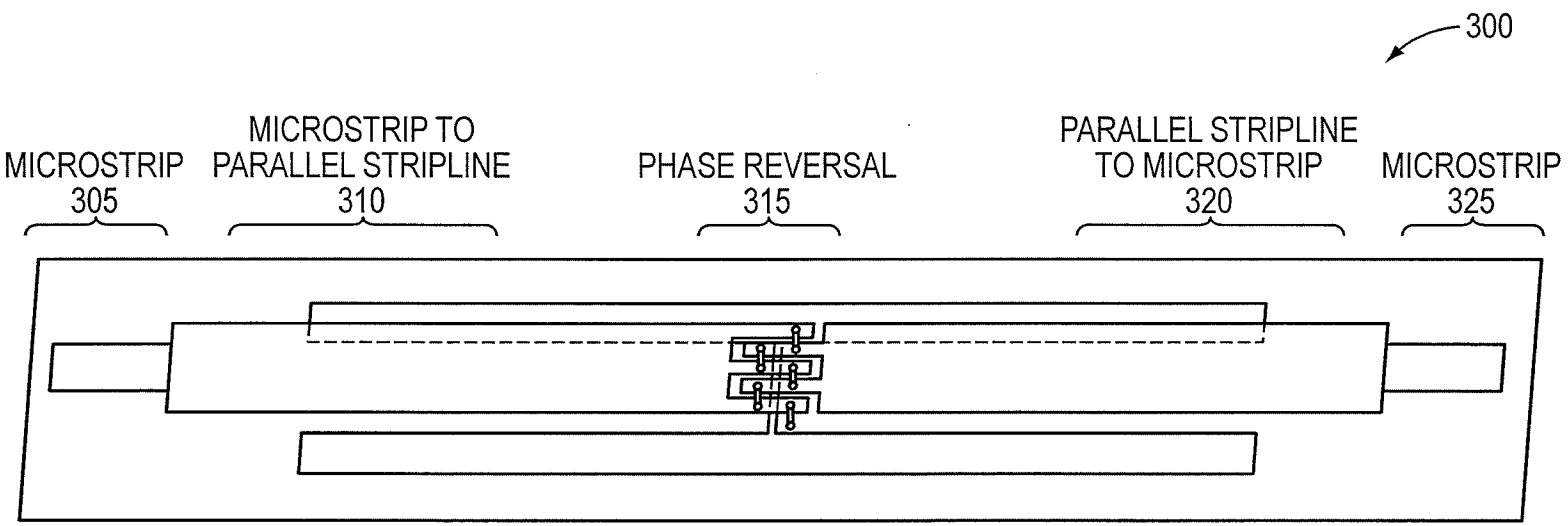
FIG. 3 is an exemplary diagram of a phase reversal structure in accordance with an illustrative embodiment of the present invention.
Figure 13:
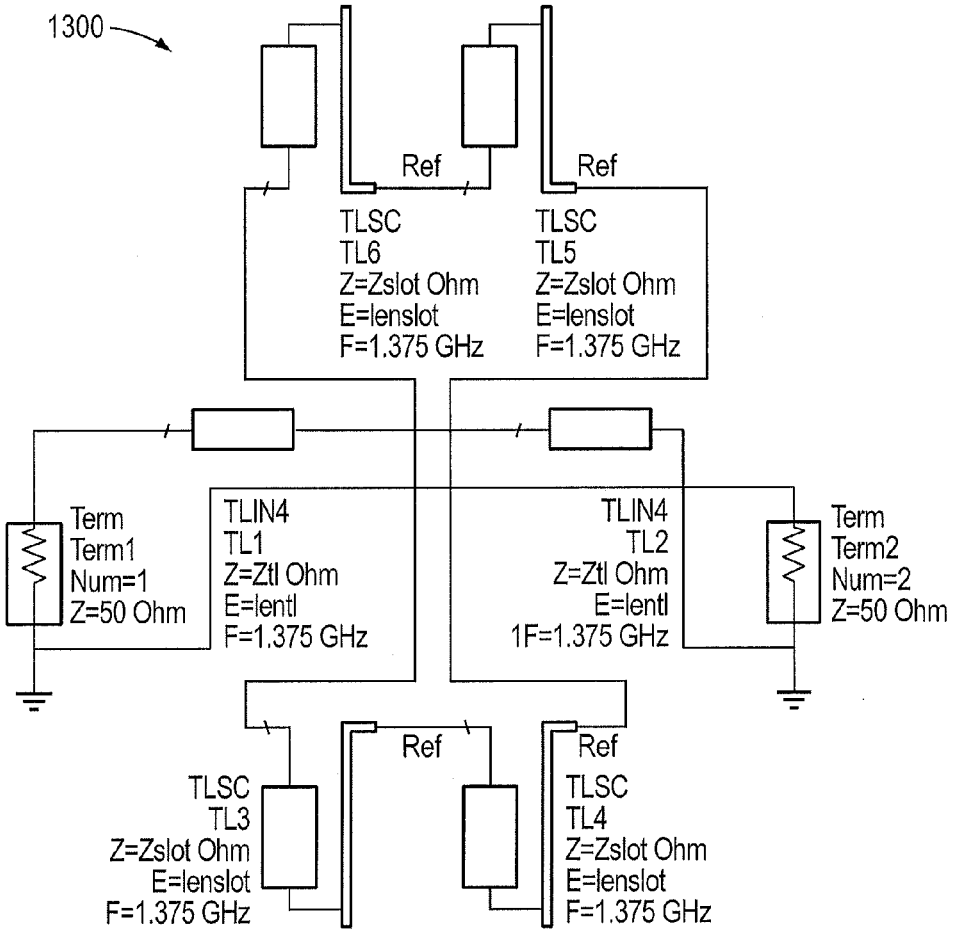
FIG. 13 is a circuit schematic of the exemplary phase reversal structure of FIG. 3 in accordance with an illustrative embodiment of the present invention.

FIG. 3 is an exemplary diagram of a phase reversal structure 300 in accordance with an illustrative embodiment of the present invention. FIG. 13 is a circuit diagram illustrating the circuit equivalent 1300 of the phase reversal structure of FIG. 3. The phase reversal structure 300 illustratively comprises of a plurality of zones. Moving from left to right in FIG. 3 are a microstrip zone 305, a microstrip to parallel strip line transition zone 310, a phase reversal zone 315, a parallel strip line to microstrip transition zone 320 and a microstrip zone 325. The microstrip zones 305, 325 comprise conventional microstrips as are well-known in the art. The microstrip to parallel strip line zone 310 and the parallel strip line to microstrip line zone 320 may be implemented using any technique for converting to/from microstrip and parallel strip lines. The phase reversal zone 315 illustratively comprises two vertical plated via holes that connects the strip lines to the ground metals located below. As a signal traverses the exemplary phase reversal structure 300 from left to right, the microstrip line is transitioned to a parallel strip line before the phase reversal structure 315 obtains the 180° phase reversal. The parallel strip line is then transitioned back to a microstrip and the signal exits in zone 325 having a 180° phase difference.

Figure 4:
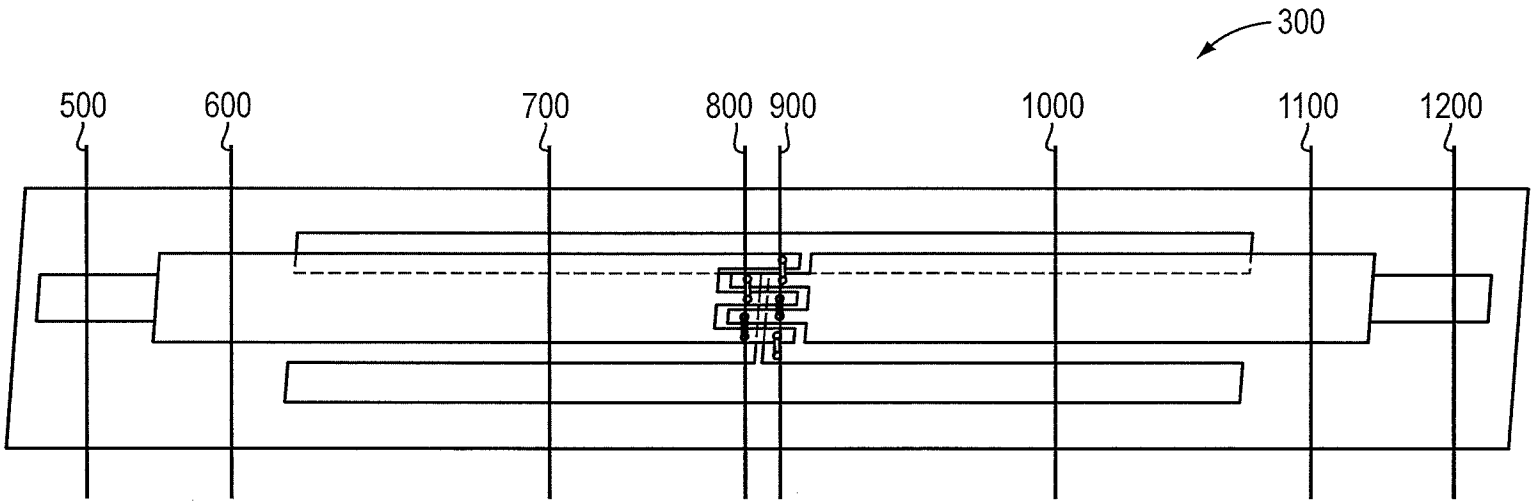
FIG. 4 is an exemplary diagram of a phase reversal structure showing cross sectional lines in accordance with an illustrative embodiment of the present invention.

FIG. 4 is an exemplary diagram of a phase reversal structure 300, such as that shown in FIG. 3, showing cross-sectional lines in accordance with an illustrative embodiment of the present invention. The phase reversal structure 300 illustrates a plurality of cross sectional lines including, e.g., a microstrip cross-sectional line 500, a microstrip cross-section 600, a parallel strip line cross-section 700, two phase reversal cross-sections 800, 900, a second parallel strip line cross section 1000, microstrip transition 1100 and a microstrip cross-section 1200. FIGS. 5-12, described further below, illustrate exemplary cross-sections of the phase reversal structured 300 at various points. These figures also illustrate direction of the electrical field flow showing a phase reversal between the input and output. It should be noted that the exemplary cross-sections shown in FIGS. 5-12, various elements may not be to scale. As such, the drawings can be taken as exemplary only and not scale representations of the widths, lengths and/or thicknesses of the various materials. As will be appreciated by those skilled in the art, the physical construction of microstrip and/or parallel straight lines may vary depending upon the desired frequency bandwidth, substrates, etc. As these are design choices that may vary depending upon the application for the quadrature fed antennas system, it should be noted that the figures are exemplary only.

Figure 5:
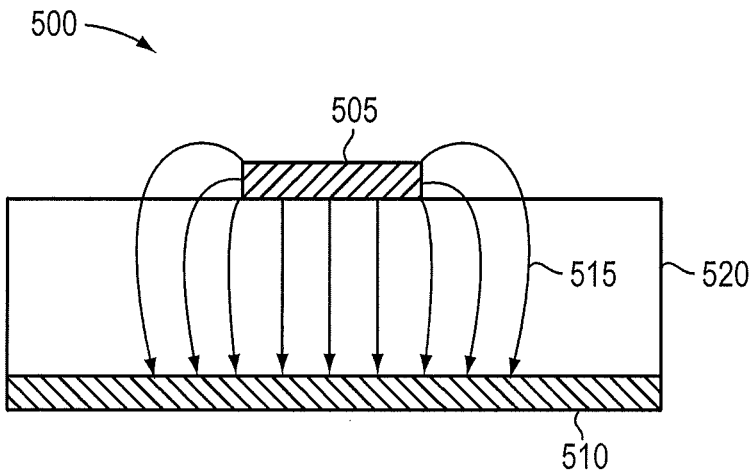
FIG. 5 is a cross section of an exemplary phase reversal structure along a microstrip line section in accordance with an illustrative embodiment of the present invention.

FIG. 5 is a cross section of an exemplary phase reversal structure in accordance with an illustrative embodiment of the present invention. The cross-section shows a portion of the microstrip line 505 section of the phase reversal structure 300. The microstrip line 505 is located along a first surface of a substrate 520. A ground plane 510 is located on the opposite surface of the substrate 520. Electric fields 515 emanate from the microstrip line 505 to the ground plane 510. For purposes of the following figures, the direction of travel of electrical fields 515 is deemed to be in a 0 degree phase. That is, when a 180 phase reversal is obtained, the direction of the electrical fields will be reversed.

Figure 6:
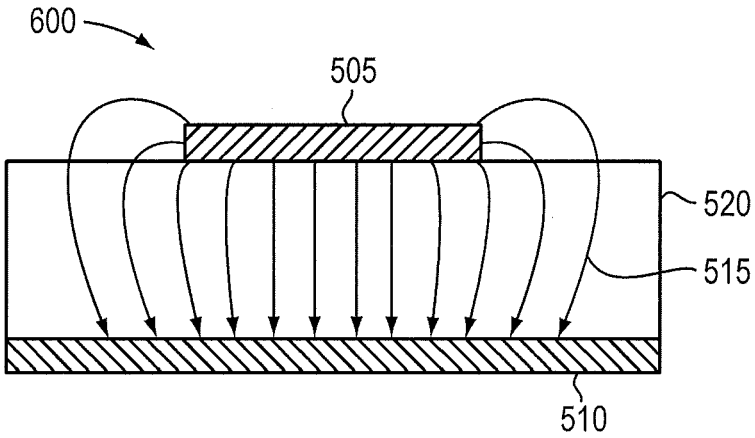
FIG. 6 is a cross section of an exemplary phase reversal structure along a microstrip line section in accordance with an illustrative embodiment of the present invention.

FIG. 6 is a cross section along line 600 of FIG. 4 of exemplary phase reversal structure in accordance with an illustrative embodiment of the present invention. Illustratively, cross-section 600 illustrates a portion of the microstrip line 505 wherein the top conductor has increased in size in preparation for the microstrip to parallel strip line conversion, which occurs along cross-sectional line 700 described further below in reference to FIG. 7. The view along cross-sectional line 600 is similar to the view along cross-sectional line 500; however, top conductor 505 has increased in size along line 600.

Figure 7:
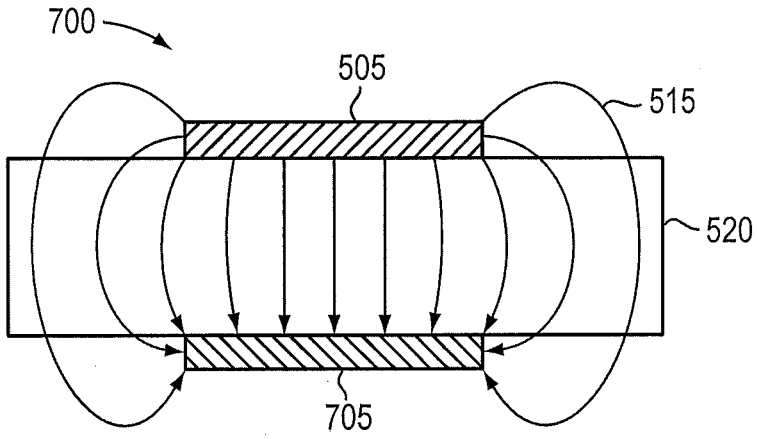
FIG. 7 is a cross section of an exemplary phase reversal structure along a microstrip line section in accordance with an illustrative embodiment of the present invention.

FIG. 7 is a cross section of an exemplary phase reversal structure at a parallel strip line cross-section 700 in accordance with an illustrative embodiment of the present invention. FIG. 7 is a cross section of an exemplary phase reversal structure in accordance with an illustrative embodiment of the present invention. In FIG. 7, the cross section 700 illustrates a top conductor 505 being substantially the same size as a bottom conductor 705. It should be noted that there is no longer a ground plane 510 along the bottom layer of the substrate 520. Instead, the ground plane 510 has narrowed to a second, parallel conductor that is substantially the same size as the top conductor 505. Electric fields 515 emanate from the top conductor 505 to the bottom conductor 705 passing through the substrate 520.

Figure 8:
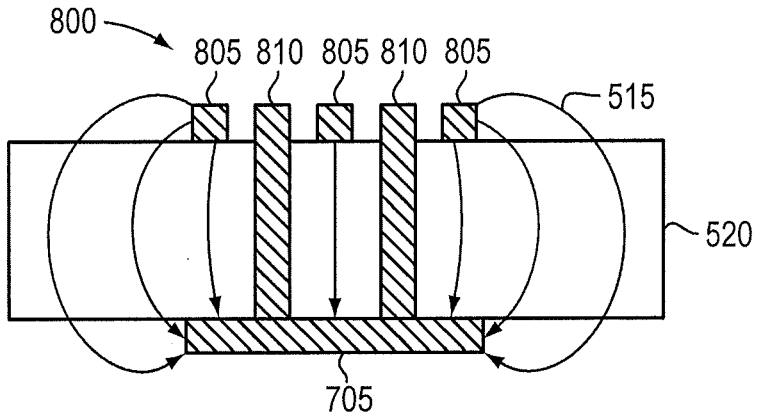
FIG. 8 is a cross section of an exemplary phase reversal structure along a microstrip line section in accordance with an illustrative embodiment of the present invention.

FIG. 8 is a cross-section of an exemplary phase reversal structure at a first phase reversal zone cross-section 800 in accordance with an illustrative embodiment of the present invention. A cross-sectional view 800 illustrates the first of a series of vias 810 that directly transmit the incoming signal from the top conductor 505 to the bottom conductor 705. Illustratively, the plurality of vias 810 are arranged that pass through the substrate 520. Other portions of the top conductor 505 are etched out to leave sections 805. It should be noted that while two vias 810 are shown in exemplary cross-section 800, the principles of the present invention may work using any number of electrical electrically conductive vias. As such, the description of two vias as being utilized should to be taken as exemplary only.

Figure 9:
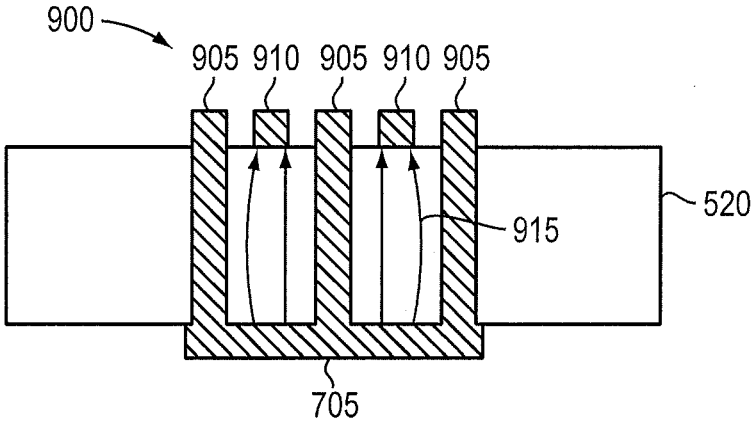
FIG. 9 is a cross section of an exemplary phase reversal structure along a microstrip line section in accordance with an illustrative embodiment of the present invention.

FIG. 9 is a cross-section of an exemplary phase reversal structure at a second phase reversal cross-section 900 in accordance with an illustrative embodiment of the present invention. At cross section 900, the sections 805 of top conductor from FIG. 8 are extended through the substrate 520 to form a second set of vias 905 that interconnect with the bottom conductor 705. Vias 810, described above in relation to FIG. 8, continue as conductors located only on the top portion of substrate 520. It should be noted that at cross section 900, the electrical fields 915 have shifted phase 180 degrees and now emanate from the bottom conductor 705 and pass through the substrate 520 to top conductor 910.

Figure 10:
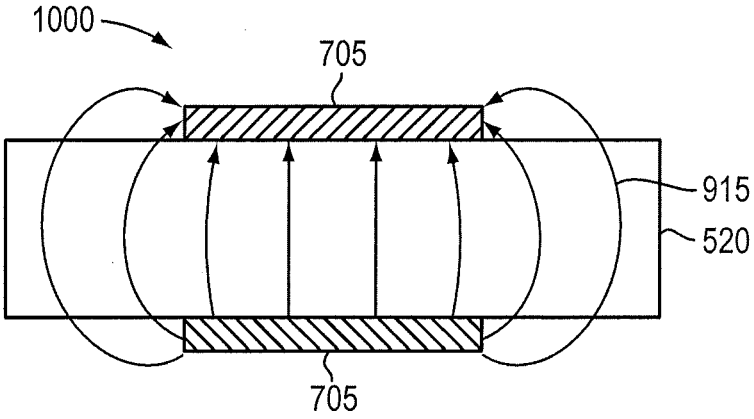
FIG. 10 is a cross section of an exemplary phase reversal structure along a microstrip line section in accordance with an illustrative embodiment of the present invention.

FIG. 10 is a cross-section of an exemplary phase reversal structure illustrating a parallel strip line to microstrip line cross-section 1000 in accordance with an illustrative embodiment of the present invention. At cross section 1000, the top conductors 910 have expanded to a single top conductor 505. As will be appreciated by those skilled in the art, cross section 1000 represents a 180 degree phase reversal of that shown in cross section 700.

Figure 11:
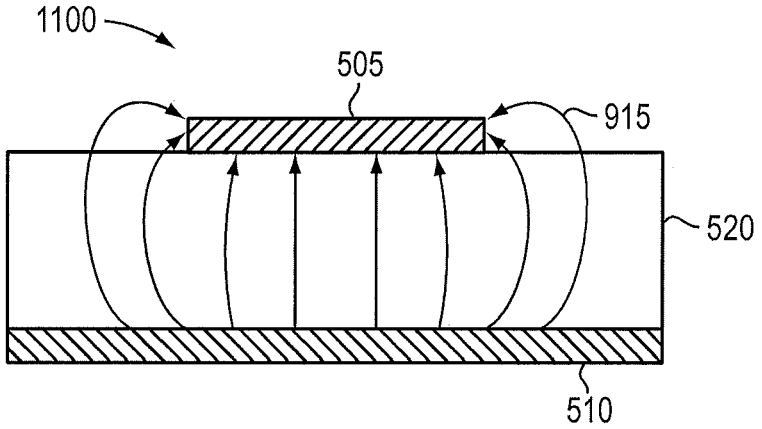
FIG. 11 is a cross section of an exemplary phase reversal structure along a microstrip line section in accordance with an illustrative embodiment of the present invention.
Figure 12:
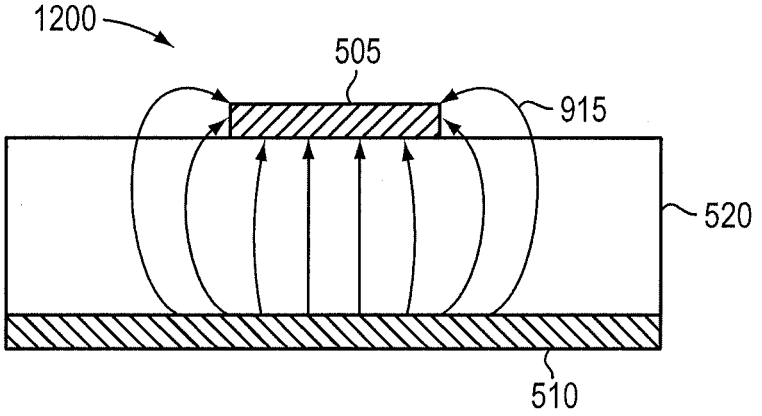
FIG. 12 is a cross section of an exemplary phase reversal structure along a microstrip in accordance with an illustrative embodiment of the present invention.

FIG. 11 is a cross-section of an exemplary phase reversal structure illustrating a cross-section of 1100 in accordance with an illustrative embodiment of the present invention. At cross section 1100, the bottom conductor has expanded to become a ground plane 510. As such, the parallel strip line has become a microstrip line with electrical fields 915 flowing from the ground place 510 to the top conductor 505. FIG. 12 is a cross-section of an illustrative exemplary phase reversal structure in a microstrip cross-section 1200 in accordance with an illustrative embodiment of the present invention. Cross section 1200 is similar to cross section 1100, however, the top conductor 505 is smaller in width.

The various cross sectional figures shown in FIGS. 5-12 are shown to illustrate an exemplary embodiment of a 180 degree phase reversal structure in accordance with an illustrative embodiment of the present invention. As will be appreciated by those skilled in the art, the exact sizes of conductors, vias, substrates as well as the materials utilized may be varied in accordance with design choices. As such, the description contained above should be taken to detail the general outline of a system that provides for the generation of a 180 degree phase difference output for use in a quadrature feed antenna network.

Figure 14:
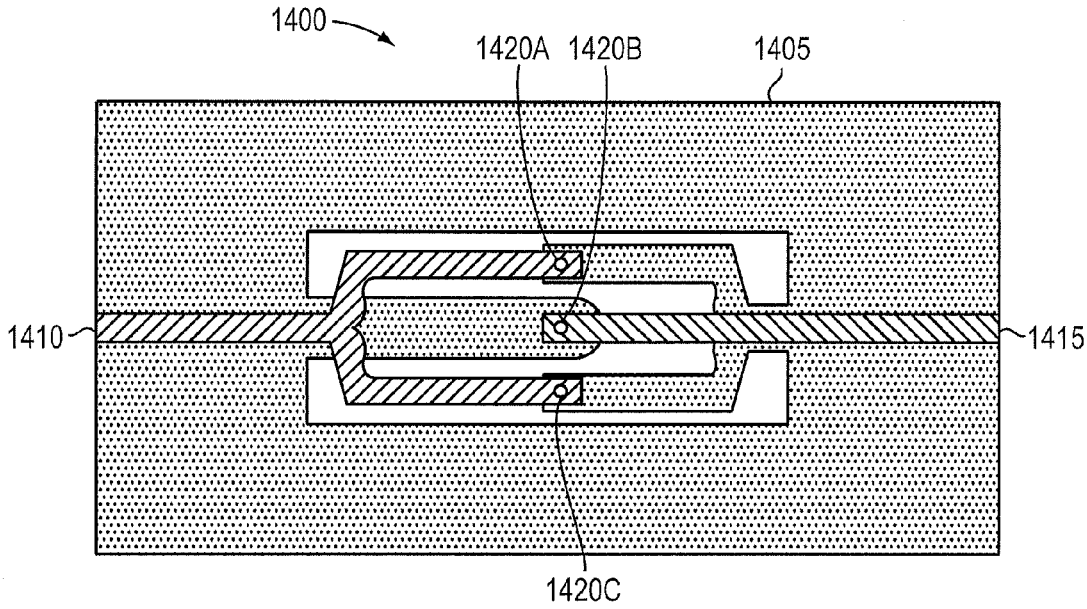
FIG. 14 is a diagram illustrating an exemplary phase reversal structure in accordance with an illustrative embodiment of the present invention.

FIG. 14 is a diagram illustrating an exemplary phase reversal 1400 in accordance with an illustrative embodiment of the present invention. Phase reversal structure 1400 comprises an alternative embodiment to the phase reversal structure 300 described above in relation to FIG. 3. Exemplary phase reversal structure 1400 comprises of a microstrip line 1410 that comprises a plurality of vias 1420A,C to a ground place 1405. A second micro strip line 1415 contains a via 1420B to the ground plane 1405. In exemplary phase reversal structure 1400, a signal entering the structure 1400 at a 0 degree phase on micro strip 1410, leaves the phase reversal structure 1400 at microstrip line 1415.

Figure 15:
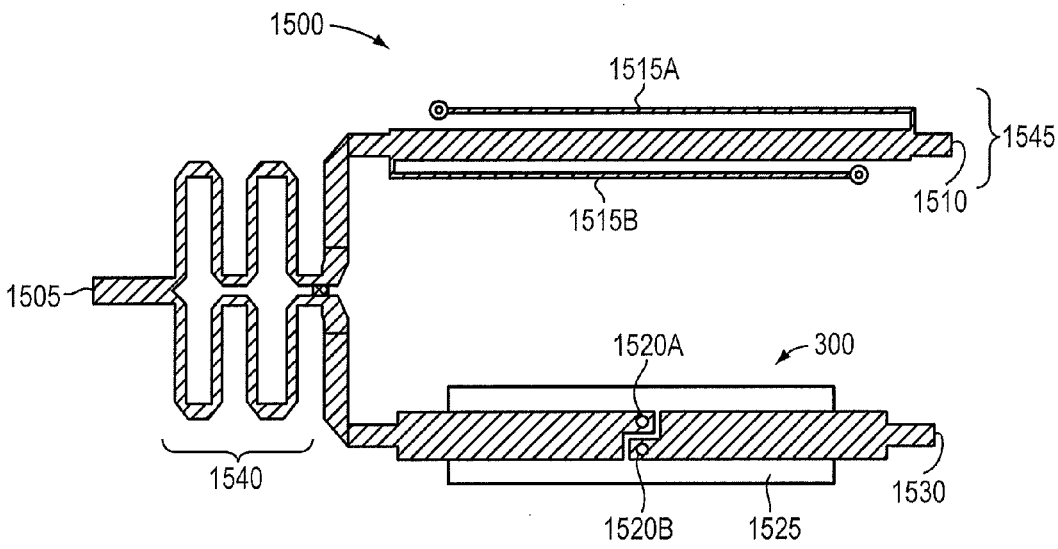
FIG. 15 is a diagram illustrating an exemplary 180 degree phase shifter that generates two outputs having a 180 degree phase difference in accordance with an illustrative embodiment of the present invention.

FIG. 15 is a diagram illustrating an exemplary 180 degree phase shifter structure 1500 in accordance with one embodiment of the present invention. Generally, the phase shifter structure 1500 comprises a phase reversal structure and generates two outputs having a 180 degree phase difference. The phase shifter structure 1500 is illustratively an alternative embodiment the phase reversal structure described above in relation to FIG. 3. Exemplary phase shifter structure 1500 includes a microstrip line 1505 that enters a power divider 1540 that sends a portion of the signal to a phase reversal module 300 and a portion of the signal to a bandpass filter module 1545. The phase reversal structure 300 is illustratively shown with two vias 1520A,B; however, it should be noted that in alternative embodiments, varying numbers of vias may be utilized. An output signal is provided at micro strip 1530 that is 180 degrees of the input signal 1505. The bandpass filter module 1545 illustratively comprises of a shunted microstrip line filter. Exemplary bandpass filter module 1545 includes a microstrip transmission line 1510 and a plurality of shunted short-circuited stubs 1515A,B. While two shunted short circuit stubs are shown, it should be noted that in alternative embodiments of the present invention, differing numbers may be utilized. As such, the description of two shunted short circuit stubs should be taken to be exemplary only. Illustratively, the shunted short circuit stubs 1515 have an electrical length of approximately 90 degrees. Further, they have a high characteristic impedance.

What is claimed is:

1. An antenna feed system comprising:

a phase shifter configured to accept an electronic signal as an input and configured to generate output signals having a 0° and 180° phase, wherein the phase shifter comprises a first microstrip region, a first parallel strip line region, a phase reversal region, a second parallel strip line region and a second microstrip region and wherein the phase reversal region comprises a plurality of vias that connect a first conductor located on a first side of a substrate with a second conductor located on a second side of the substrate; and a first hybrid coupler configured to accept the 0° output from the phase shifter and generate a 0° and a 90° phase output;

a second hybrid coupler configured to accept the 180° phase output and generate a 180° and a 270° output;

a reference path operatively interconnected with the phase shifter.

2. The antenna feed system of claim 1 wherein the reference path is approximately a same length of transmission line as the phase shifter.

3. The antenna feed system of claim 1 wherein the reference path comprises a bandpass filter.

4. The antenna feed system of claim 3 wherein the bandpass filter comprises a set of short circuit stubs.

5. The antenna feed system of claim 1 further comprising a microstrip line to parallel strip line transition region located between the first microstrip region and the first parallel strip line region.

6. The antenna feed system of claim 1 further comprising of a parallel strip line to microstrip line transition region located between the second parallel strip line region and the second microstrip line region.

7. An antenna feed system comprising:

a microstrip line to parallel strip line transition region;

a parallel strip line to microstrip line transition region;

a phase reversal region located between the microstrip line to parallel strip line transition region and the parallel strip line to microstrip line transition region; and a reference path.

8. The antenna feed system of claim 7 wherein the phase reversal region comprises a parallel strip line having a plurality of vias between a first conductor located on a first surface of a substrate and a second conductor located on a second surface of the substrate.

9. The antenna feed system of claim 7 wherein the reference path comprises a bandpass filter with at least one short circuit stub.

10. The antenna feed system of claim 7 wherein the reference path comprises of a bandpass filter.

* * * * *